US007077042B2

(12) United States Patent
Nogawa et al.

(10) Patent No.: US 7,077,042 B2
(45) Date of Patent: Jul. 18, 2006

(54) THREE-SIDE TRIMMER

(75) Inventors: Masato Nogawa, Shiga (JP); Tatsuo Uchida, Otsu (JP); Yoshiyuki Horii, Kyoto (JP); Ko Ouchiyama, Omihachiman (JP)

(73) Assignee: Horizon International Inc., Shiga (JP)

( * ) Notice: Subject to any disclaimer, the term of this patent is extended or adjusted under 35 U.S.C. 154(b) by 541 days.

(21) Appl. No.: 09/982,663

(22) Filed: Oct. 17, 2001

(65) Prior Publication Data

US 2002/0044852 A1 Apr. 18, 2002

(30) Foreign Application Priority Data

Oct. 18, 2000 (JP) ..... 2000-317862

(51) Int. Cl.
*B26D 5/42* (2006.01)

(52) U.S. Cl. ..... 83/466; 83/530; 83/934

(58) Field of Classification Search ..... 83/934, 83/530, 466
See application file for complete search history.

(56) References Cited

U.S. PATENT DOCUMENTS

| | | | | |
|---|---|---|---|---|
| 2,781,842 | A | 2/1957 | Williams | |
| 3,182,542 | A | 5/1965 | Cochran | |
| 3,496,823 | A | 2/1970 | Kruse | |
| 3,732,766 | A | 5/1973 | McCain et al. | |
| 4,505,173 | A | 3/1985 | Hartlage | |
| 4,635,542 | A * | 1/1987 | Sebelist et al. | 100/3 |
| 5,488,886 | A * | 2/1996 | Mohr | 83/29 |
| 6,708,967 | B1 * | 3/2004 | Trovinger et al. | 270/52.26 |

FOREIGN PATENT DOCUMENTS

| | | |
|---|---|---|
| DE | 198 43 011 A | 3/2000 |
| EP | 0 584 602 A | 3/1994 |
| EP | 0 641 631 A | 3/1995 |
| EP | 0 887 157 A | 12/1998 |
| EP | 0 485 542 B2 | 6/2000 |

* cited by examiner

*Primary Examiner*—Kenneth E. Peterson
(74) *Attorney, Agent, or Firm*—Hodgson Russ LLP

(57) ABSTRACT

The three-side trimmer comprises an alignment station (F) for receiving booklet bundle (32) and aligning the booklets, and a cutting station (D) for cutting the top, bottom and fore edges of the bundle, and a chuck mechanism (40) which holds the bundle and conveys it to the cutting station. The cutting station has a cutting table (23), a top edge cutting knife (43), a bottom edge cutting knife (44), a fore edge cutting knife 42, and a pressing plate 48 movable between a waiting position and a working position. An encoder reads the data about the rotational position of the servomotor (38) in the chuck mechanism while it holds the booklet bundle. The control portion (25) measures the height of the bundle and controls a driving mechanism of the pressing plate such that the pressing plate moves up and down between waiting and working positions.

5 Claims, 10 Drawing Sheets

THREE-SIDE TRIMMER

CLAIM OF PRIORITY

This application claims priority based on Japanese Patent Application Number 2000-317862, that was filed on Oct. 18, 2000.

BACKGROUND OF THE INVENTION

The present invention relates to a three-side trimmer for cutting the top edge, the bottom edge and the fore edge of a booklet bundle comprising a multiple of stacked booklets so as to trim them.

In bookbinding, after aligning the back of a pile a predetermined number of papers, adhesive is applied on its back surface and a cover is attached thereon so that a booklet is formed. The top edge, bottom edge and the fore edge of the booklet are cut respectively by a top edge cutting knife, bottom edge cutting knife and fore edge cutting knife in a three-side trimmer so as to be trimmed. After this treatment, the booklet will be conveyed to the next treating process.

Recently, in order to improve the efficiency of bookbinding, it becomes common that a booklet bundle is formed. And the booklet bundle is positioned in a predetermined position in a three-side trimmer, then the top edge, bottom edge and the fore edge of the booklet bundle are cut simultaneously.

FIG. 9 is a schematic view of a three-side trimmer in the prior art. Referring to FIG. 9, a booklet bundle 2 is conveyed by a conveying belt 3 into the three-side trimmer 1 in the direction indicated by the arrow A in the figure. Reference numerals 4*a*, 4*b* denote a convey claw pressing the bottom edge of the booklet bundle 2, and 5*a*, 5*b* guides for guiding the fore edge and the back edge of the booklet bundle 2, respectively. When the booklet bundle 2 enters into the alignment portion C and the top edge of the booklet bundle 2 contacts with a top edge guides 7*a* and 7*b*, the booklet bundle 2 stops. Then the fore edges of each of the booklets in the booklet bundle 2 are aligned so as to form a plane, by means of an alignment plate 11.

Reference numeral 6 denotes a back edge guide, 8 a servomotor, 9 a ball screw, arid 10 a chuck attached to the ball screw 9. When the servomotor 8 is driven, the ball screw 9 is driven to rotate through a connecting journal mechanism so that the chuck 10 moves in the direction indicated by the arrow B in the figure.

After aligning the fore edge, top edge and the bottom edge of each of the booklets in the booklet bundle 2, the booklet bundle 2 is pinched by the chuck 10. Then, the servomotor 8 is driven so as to drive the ball screw 9 to rotate. Thus, according the movement of the chuck 10, the booklet bundle 2 is conveyed along the direction of the arrow B shown in the figure, which is perpendicular to the conveying direction A of the convey belt 3, and finally arrives to the cutting portion D.

In the cutting portion D, the booklet bundle 2 is pressed from the upper side thereof by a pressing plate (not shown), and the booklet bundle 2 is fixed to a stationary position. Then, the fore edge, top edge and the bottom edge of each of the booklets in the booklet bundle are cut, respectively by means of a fore edge cutting knife 12, top edge cutting knife 13 and bottom edge cutting knife 14.

FIG. 10 is a side view of the alignment portion C and the cutting portion D, seen from the direction of arrow E, shown in the figure. The chuck 10 comprises a fixed block 10*b* for supporting the bottom surface of the booklet bundle 2 and a moving block 10*a*, which can move up and down with respect to the fixed block 10*b*, as shown in FIG. 10. The moving block 10*a* is driven by a proper driving mechanism, for example, an air cylinder or a cam mechanism. The moving block 10*a* has a waiting position, the height of which is higher than the height of the booklet bundle, and a working position for pinching the booklet bundle in cooperation with the fixed block 10*b*. Thus, the pinching of the booklet bundle 2 by the chuck 10 is carried out by the moving down of the moving block 10*a* in the direction indicated by the arrow P from the waiting position so as to pinch the booklet bundle 2 in cooperation with the fixed block 10*b* therebetween In this case, the height of the booklet bundle 2 depends upon the height of each of the booklets and the number thereof in the booklet bundle 2. Therefore, the height of the waiting position of the moving block 10*a* can be so designed that the height corresponds to the maximum value of possible height of the booklet bundle 2 so as to prepare to respond easily to any change of the height of the booklet bundle 2.

However, when the height of the waiting position of the moving block 10*a* is so designed that it corresponds to the maximum value of the possible height of the booklet bundle 2, it would take rather long time to lower the moving block 10*a* for pinching the booklet bundle 2 in cooperation with the fixed block 10*b*, if the height of the booklet bundle is rather low compared to the expected maximum height of the booklet bundle 2. As a result, it takes a longer time to convey the booklet bundle 2 from the alignment portion C to the cutting portion D. Additionally, it takes a longer time to convey the next booklet bundle into the alignment portion C. Consequently, there arises a problem that a longer time is required to cut a booklet bundle.

Reduction of the time required for the preparation of the booklet bundle cutting may be realized also by driving the moving block 10*a* by means of, for example, air cylinder or hydraulic cylinder so that the block moves in high speed for pinching the booklet bundle. However, in this case, the moving block 10*a* collides with the booklet bundle at a high velocity, and there arises a problem that the booklet can be injured. Considering these problems, in three-side trimmers in the prior art, the moving block 10*a* is designed to move in a short stroke region. And in the initial state, the waiting position of the moving block 10*a* is set at an arbitrary height. The level of the height of the waiting position is adjusted in response to the height of the respective booklet bundle so that a high speed treatment can be realized.

The cutting portion D comprises a pressing plate 18 and a driving motor 19. A power transmission means 15, for example, timing belt, is connected to the driving shaft of the driving motor 19 so as to transmit the power to the pressing plate 18 through a nut 16 and a screw 17. The pressing plate 18 can be positioned at a waiting position, which is positioned at a point higher than the height of the booklet bundle 2, or at a working position for pressing the booklet bundle 2 from the upper side thereof. A signal corresponding to the height of the booklet bundle 2 to be cut is inputted to a controller of the driving motor 19. The controller outputs a control signal in response to the height to the driving motor 14. In this way, the pressing plate 18 moves down from the waiting position in the direction indicated by the arrow Q to the working position to press the booklet bundle 2.

The pressing plate 18 is designed similarly to the moving block 10*a*. Namely, in order to avoid the injuring of the booklets and simultaneously to realize a high-speed treatment, the pressing plate 18 moves in a short stroke region.

And the height of the waiting position can be adjusted in response to the height of the booklet bundle so as to press the booklet bundle properly.

Accordingly, in the tree-knife trimmer in the prior art, data for determining the height level of the waiting block must be inputted for each batch of booklets, considering the height of each of the booklets. The data is inputted to the control portion of the driving means for the moving block of the chuck, which is disposed in the alignment portion. Thus, there arises problems that the handling of the three-side trimmer is not simple, and long time is necessary for the trimming treatment.

Moreover, such three-side trimmer cuts a plurality of booklets simultaneously, therefore, the number of the booklets have to be counted at sight for each trimming treatment. The counted number shall be summed to get the total number of the trimmed booklets. The summing of the number of the trimmed booklets is bothersome. And there is a problem that mistakes can take place in the summing.

SUMMARY OF THE INVENTION

An object of the present invention is to provide a three-side trimmer, in which the adjustment of the height of the waiting position of the pressing plate in the cutting portion therein, and the height of the waiting position of the moving plate of the chuck for conveying the booklet bundle from the alignment portion to the cutting portion can be carried out automatically, so that the time required for cutting a booklet bundle can be shortened.

Another object of the present invention is to provide a three-side trimmer, in which the summing of the number of the trimmed booklets can be carried out quickly and exactly.

In order to attain the object, according to the present invention, there is provided a three-side trimmer which comprises an alignment station for receiving a booklet bundle composed of stacked booklets and adjusting the booklets in the height direction, an alignment means arranged in the alignment station for aligning the top edge and/or bottom edge of the booklets along with the fore edge of the booklets, a cutting station for cutting the top edge, bottom edge and fore edge of the booklet bundle, a chuck mechanism for holding the booklet bundle in the vertical direction, and conveying the booklet bundle from the alignment station to the cutting station, a cutting table arranged in the cutting station for supporting the booklet bundle thereon, a top edge cutting knife arranged in the cutting station for upwardly and downwardly movement so as to cut the top edge of the booklet bundle, a bottom edge cutting knife arranged in the cutting station in parallel to the top edge cutting knife for upwardly and downwardly movement so as to cut the bottom edge of the booklet bundle, a fore edge cutting knife arranged in the cutting station in perpendicular to the top edge cutting knife and the bottom edge cutting knife for upwardly and downwardly movement so as to cut the fore edge of the booklet bundle, a pressing plate arranged in the cutting station for upwardly and downwardly movement between a waiting position, which is positioned over the booklet bundle, and a working position where the pressing plate presses the booklet bundle to the cutting table, a driving mechanism for upwardly and downwardly moving the pressing plate, a measuring means for measuring the height of the booklet bundle while the chuck mechanism holds the booklet bundle, and control means for controlling the driving mechanism according to the value measured by the measuring means in such a manner that the waiting position of the pressing plate to a height level is adjusted corresponding to the height of the booklet bundle and the pressing plate upwardly and downwardly moves between the adjusted waiting position and the working position.

According to the preferred embodiment of the invention, the three-side trimmer further comprises a receiving station for receiving a booklet bundle, a conveying means for holding the booklet bundle in the vertical direction and conveying the booklet bundle from the receiving station to the alignment station and a second measuring means for measuring the height of the booklet bundle while the conveying means holds the booklet bundle. The chuck mechanism comprises a fixed block for supporting the bottom surface of the booklet bundle, a moving block upwardly and downwardly movable with respect to the fixed block, and a second driving means for driving the moving block to move between the waiting position, which is positioned over the booklet bundle, and a working position where the moving block pinches the booklet bundle in cooperation with the fixed block. The control means controls the second driving mechanism in response to the measured value by the second measuring means in such a manner that the waiting position of the moving block in the chuck mechanism is adjusted corresponding to the height level of the booklet bundle and the moving block upwardly and downwardly moves between the adjusted waiting position and the working position.

According to another preferred embodiment of the invention, the three-side trimmer further comprises an air evacuating means arranged in the receiving station for evacuating air existing between the booklets and a conveying means for conveying the booklet bundle from the receiving station to the alignment station. The air evacuating means comprises a supporting plate for supporting the bottom surface of the booklet bundle, and a pressing plate upwardly and downwardly movable with respect to the supporting plate so as to press the booklets to the supporting plate. The three-side trimmer further comprises a second measuring means for measuring the height of the booklet bundle while the pressing plate in the air evacuating means presses the booklet bundle to the supporting plate. The chuck mechanism comprises a fixed block for supporting the bottom surface of the booklet bundle, a moving block upwardly and downwardly movable with respect to the fixed block, and a second driving means for moving the moving block between the waiting position, which is positioned over the booklet bundle, and a working position where the moving block pinches the booklet bundle in cooperation with the fixed block. The control means controls the second driving means in response to the measured value by the second measuring means in such a manner that the waiting position of the moving block in the chuck mechanism is adjusted corresponding to the height level of the booklet bundle and the moving block upwardly and downwardly moves between the adjusted waiting position and the working position.

In order to attain the object, according to the present invention, there is also a three-side trimmer which comprises a receiving station for receiving a booklet bundle, an alignment station for aligning the booklets in the booklet bundle in the height direction, an alignment means arranged in the alignment station for aligning the top edge and/or bottom edge of the booklets along with the fore edge of the booklets, a conveying means for holding the booklet bundle in the vertical direction and conveying the booklet bundle from the receiving station to the alignment station, a cutting station for cutting the top edge, bottom edge and fore edge of the booklet bundle, a chuck mechanism for holding the booklet bundle in the vertical direction and conveying the booklet bundle from the alignment station to the cutting station, a cutting table arranged in the cutting station for supporting the booklet bundle thereon, a top edge cutting knife arranged in the cutting station for upwardly and downwardly movement so as to cut the top edge of the booklet bundle, a bottom edge cutting knife arranged in the cutting station in parallel to the top edge cutting knife for upwardly and downwardly movement so as to cut the bottom edge of the booklet bundle, a fore edge cutting knife arranged in the cutting station in perpendicular to the top edge cutting knife and the bottom edge cutting knife for upwardly and downwardly movement so as to cut the fore edge of the booklet bundle, a pressing plate arranged in the cutting station for upwardly and downwardly movement between a waiting position, which is positioned over the booklet bundle, and a working position where the pressing plate presses the booklet bundle to the cutting table, a driving mechanism for upwardly and downwardly moving the pressing plate, a measuring means for measuring the height of the booklet bundle while the chuck mechanism holds the booklet bundle, and control means for controlling the driving mechanism in response to the value measured by the measuring means in such a manner that the waiting position of the pressing plate is adjusted to a height level corresponding to the height of the booklet bundle and the pressing plate upwardly and downwardly moves between the adjusted waiting position and the working position.

In order to achieve the object, according to the present invention, there is also provided a three-side trimmer which comprises a receiving station for receiving a booklet bundle, an air evacuating means arranged in the receiving station for evacuating air existing between the booklets, the air evacuating means comprising a supporting plate for supporting the bottom surface of the booklet bundle, and a pressing plate upwardly and downwardly movable with respect to the supporting plate so as to press the booklets to the supporting plate, an alignment station for aligning the booklets in the booklet bundle in the height direction, an alignment means arranged in the alignment station for aligning the top edge and/or bottom edge of the booklets along with the fore edge of the booklets, a conveying means for holding the booklet bundle in the vertical direction and conveying the booklet bundle from the receiving station to the alignment station, a cutting station for cutting the top edge, bottom edge and fore edge of the booklet bundle, a chuck mechanism for holding the booklet bundle in the vertical direction, and conveying the booklet bundle from the alignment station to the cutting station, a cutting table arranged in the cutting station for supporting the booklet bundle thereon, a top edge cutting knife arranged in the cutting station for upwardly and downwardly movement so as to cut the top edge of the booklet bundle, a bottom edge cutting knife arranged in the cutting station in parallel to the top edge cutting knife for upwardly and downwardly movement so as to cut the bottom edge of the booklet bundle, a fore edge cutting knife arranged in the cutting station in perpendicular to the top edge cutting knife and the bottom edge cutting knife for upwardly and downwardly movement so as to cut the fore edge of the booklet bundle, a pressing plate arranged in the cutting station for upwardly and downwardly movement between a waiting position, which is positioned over the booklet bundle, and a working position where the pressing plate presses the booklet bundle to the cutting table, a driving mechanism for moving the pressing plate up and down, a measuring means for measuring the height of the booklet bundle while the pressing plate in the air evacuating means presses the booklet bundle to the supporting plate, and a control means for controlling the driving means in response to the measured value by the measuring means in such a manner that the waiting position of the moving block in the chuck mechanism is adjusted corresponding to the height level of the booklet bundle and the moving block upwardly and downwardly moves between the adjusted waiting position and the working position.

According to further preferred embodiment of the invention, the number of the booklets to be cut is counted according to the measured value by the measuring means or the second measuring means along with the thickness of a booklet in a booklet bundle.

DETAILED DESCRIPTION OF THE PREFERRED EMBODIMENTS

Figure 1:
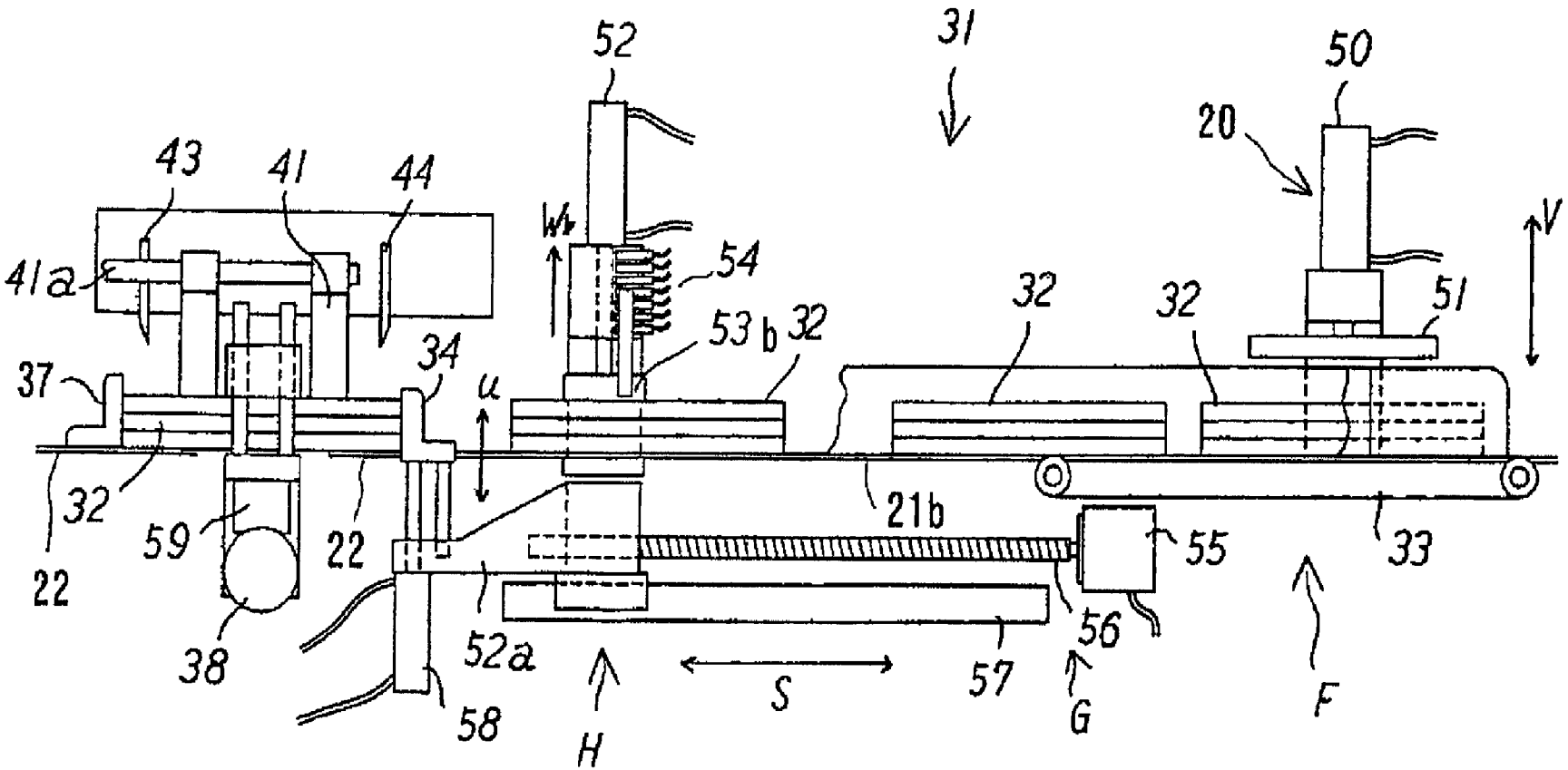
FIG. 1 is a schematic view of the three-side trimmer according to a preferred embodiment of the present invention.
Figure 2:
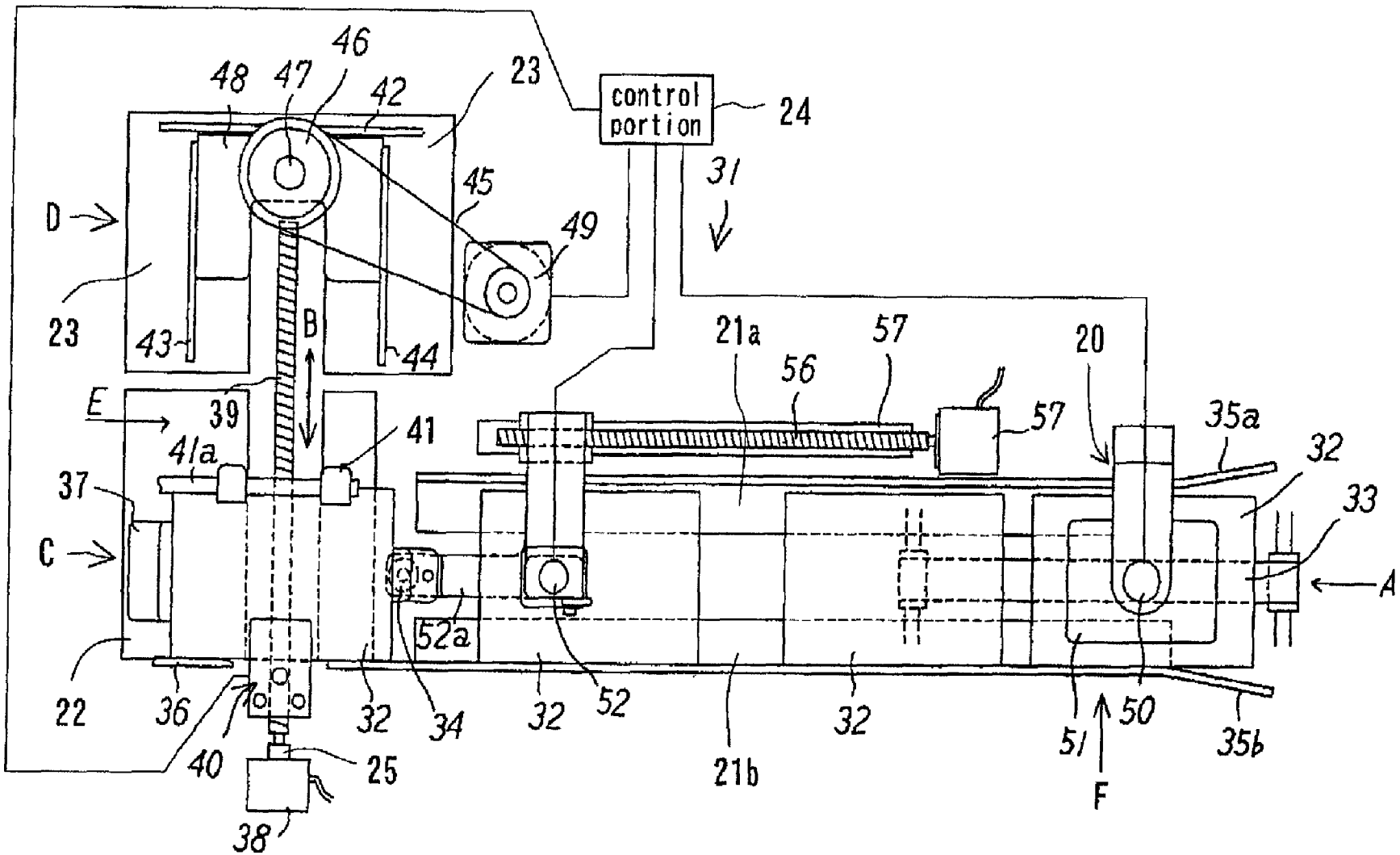
FIG. 2 is a plan view of the three-side trimmer shown in FIG. 1.
Figure 3:
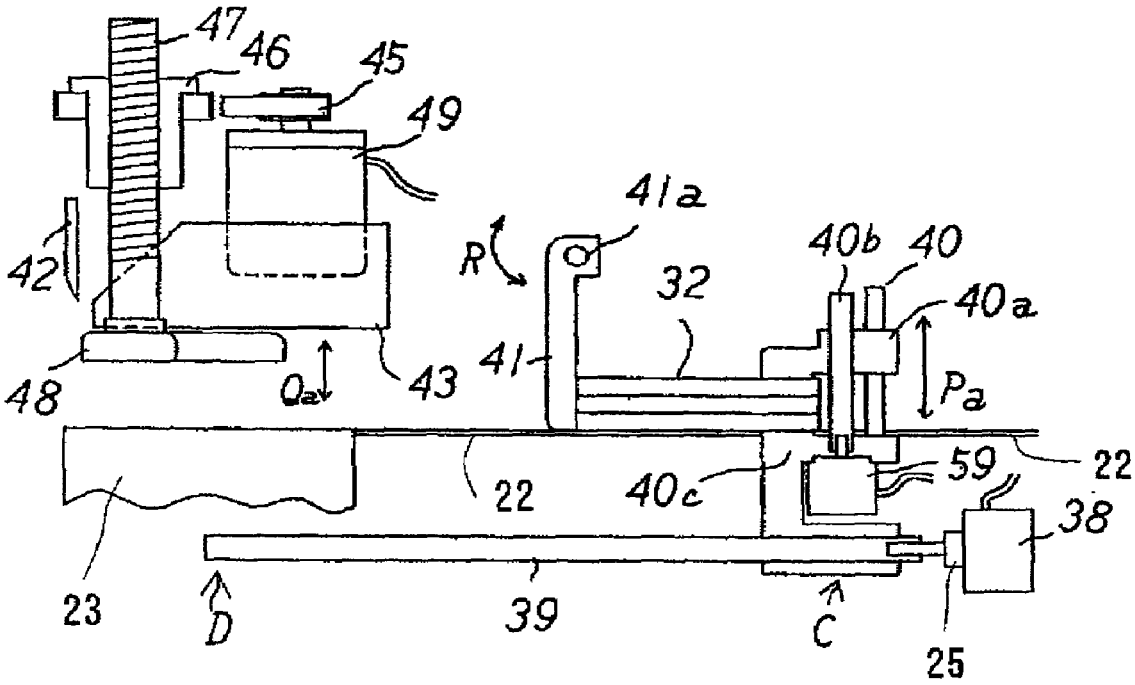
FIG. 3 is a side view of the three-side trimmer seen from the direction shown by the arrow E in FIG. 2.

A preferred embodiment of the present invention is explained below, referring to the accompanied drawings. FIG. 1 is a schematic view of the three-side trimmer according to a preferred embodiment of the present invention. FIG. 2 is a plan view of the three-side trimmer shown in FIG. 1. FIG. 3 is a side view of the three-side trimmer seen from the direction shown by the arrow E in FIG. 2.

As shown in FIGS. 1 to 3, the three-side trimmer 31 according to the present invention comprises a receiving station F for receiving a booklet bundle 32, which is constituted of a plurality of heaped booklets, an alignment station C for aligning each of the booklets in the booklet bundle 32 in the height direction and a cutting station D for cutting the top edge, bottom edge and fore edge of the booklet bundle 32.

A conveyer 33 is disposed in the receiving station F. The booklet bundle 32 is put onto the conveyer 33 in the receiving station F from the direction shown by the arrow A. An air evacuating apparatus 20 is disposed in the receiving station. The air evacuating apparatus 20 evacuates the air existing between the booklets in the booklet bundle 32. The air evacuating apparatus 20 comprises a supporting plates 21*a* and 21*b*, which support the bottom surface of the booklet bundle 32, and a pressing plate 51, which can move up and down with respect to the supporting plates 21*a* and 21*b* and presses the booklet bundle 32 to the supporting plates 21*a* and 21*b*. By the way, a part of the conveying surface of the conveyer 33 functions as a supporting plate. The pressing plate 51 in the air evacuating apparatus 20 moves up and down in the direction shown by the arrow V by means of a first air cylinder 50. Thus, by pressing the booklet bundle 32 from the upper side thereof by means of the pressing plate 51, the air existing between the booklets is evacuated, so that procedures in the following process can be treated smoothly. By the way, the conveyer 33 stops, while the pressing by the pressing plate 51 is undergone. The supporting plates 21*a* and 21*b* are disposed at both sides of the conveyer 33 in parallel with the conveyer 33, and extend from the receiving station to the alignment station C.

The three-side trimmer 31 according to the present invention comprises a conveying apparatus for conveying the booklet bundle from the receiving station F to the alignment station C. The conveying apparatus comprises a fixed member 53*a*, which is attached to a second air cylinder 52 and supports the bottom surface of the booklet bundle 32, and a pressing member 53*b*, which is driven by the second air cylinder 52 so as to move up and down with respect to the fixed member 53*a*. The second air cylinder 52 engages with a ball screw 56, which extends in parallel to the supporting plates 21*a* and 21*b*. The second air cylinder 52 can slide along a slide rail 57, which is disposed in parallel to the ball screw 56, namely the second air cylinder 52 is guided by the slide rail 57. The ball screw 56 can rotate around its axis by means of a driving motor 55. The second air cylinder 52 moves reciprocally in the direction shown by the arrow S, according to the rotational driving by the ball screw 56.

In this manner, the booklet bundle 32, which is conveyed to the exit of the receiving station F by the conveyer 33, is held by the fixed member 53*a* and the pressing member 53*b* in the vertical direction and is conveyed to the alignment station C by this conveying apparatus conveys.

A third air cylinder 58 is attached to the second air cylinder 52 through a connecting member 52*a*. A conveying claw 34 is disposed in the piston portion of the third air cylinder 58. The conveying claw 34 can project or retract in the direction shown by the arrow U with respect to the conveying surface of the booklet bundle 32. The conveying claw 34 is designed so as to project when the conveying apparatus holds the booklet bundle 32 at the exit of the receiving station F. The conveying claw 34 pushes forward the bottom surface of the preceding booklet bundle 32, when the conveying apparatus reaches to a positional region H in front of the alignment station C. In this positional region H, the pressing member 53*b* moves up in the direction shown by the arrow Wb so that the holding sate of the booklet bundle is released. Simultaneously, the conveying claw 34 is retraced to the downside of the conveying surface.

The second air cylinder 52 comprises a plurality of sensors 54. The sensors are disposed equidistantly in the vertical direction therein. The sensors detect the height of the pressing member, namely the height of the booklet bundle 32, in the state that the booklet bundle 32 is pinched between the pressing member 53*b* and the fixed member 53*a*. The sensors 54 are, for example, appropriate proper switches, position sensing switches or mechanical switches, or a potentiometer. The sensors 54 are connected to a control portion 24, which will be explained later, and the sensing data of the sensors 54 is sent to the control portion 24.

The alignment station C comprises second supporting plates 22 for supporting the booklet bundler 32. A top edge aligning guide 37 and a back edge aligning guide 36 are disposed in the second supporting plate 22. Further, a pressing lever 41 is disposed in the alignment station C as shown in FIG. 3, the pressing lever can rotate about a rotational axis 41*a* in the direction shown by the arrow R. The booklet bundle, which is pushed by the conveying claw 34 of the conveying apparatus, stops, when it contacts with the top edge aligning guide 37, so that the top edge of each booklets is aligned. In addition, the pressing lever 41 pushes the fore edges of each booklet of the booklet bundle 32 and the back edge of the booklet bundle 32 is pressed onto the back edge aligning guide 36, so that the back edge of each booklet is aligned.

The three-side trimmer 31 further comprise a chuck mechanism 40 for holding the booklet bundle in the vertical direction and for conveying it from the alignment station C to the cutting station D. The chuck mechanism 40 comprises a fixed block 40*c* for supporting the bottom surface of the booklet bundle 32, a moving block 40*a*, which is connected with the fixed block through a vertical threaded shaft 40*b* and can move up and down according to the rotation of the threaded shaft 40*b*, and a servomotor 59, which is attached to the fixed block 40*c* and drives the threaded shaft to rotate. The moving block 40*a* moves up and down in the direction shown by the arrow Pa, when the servomotor 59 drives the threaded shaft 40*b* to rotate. The moving block 40*a* has a waiting position, which is positioned over the booklet bundle 32, and a working position for pinching the booklet bundle in cooperation with the fixed block 40*c*.

The servomotor 59 comprises, for example, an encoder 25, as a position sensing means. This encoder 25 acquires the rotational position data of the servomotor 59 in the state that the booklet bundle 32 is pinched by the moving block 40*a* and the fixed block 40*c* in the chuck mechanism 40. The rotational position data is sent to the control portion 24, which will be explained later. The control portion 24 obtains the height of the booklet bundle 32, on the basis of this rotational position data.

The fixed block 40*c* in the chuck mechanism 40 engages with a ball screw 39, which extends from the alignment station C to the cutting station D, namely it extends perpendicular to the conveying direction of the conveying apparatus to the supporting plate 22. The ball screw 39 is driven by a servomotor 38 to rotate around the axis thereof. The fixed block 40*c* moves reciprocally in the direction shown by the arrow B, when the ball screw 39 is driven by the servomotor 38 to rotate.

In this way, the booklet bundle 32 is held by the chuck mechanism 40 in the vertical direction and is conveyed to the cutting station D, after that the top edge and back edged thereof are aligned in the alignment station C.

In the cutting station D, there provided a cutting table 23 for supporting the booklet bundle 32, a top edge cutting knife 43 for cutting the top edge of booklet bundle 32, which can move up and down, a bottom edge cutting knife 44 for cutting the bottom edge of booklet bundle 32, which is disposed in parallel to the top edge cutting knife 43 and can move up and down, and a fore edge cutting knife 42 for cutting the fore edge of the booklet bundle 32, which is disposed in perpendicular to the top edge cutting knife 43 and the bottom edge cutting knife 44 and can move up and down. Also a knife receiving plate (not shown in the figure) is disposed on the cutting table 23. The knife receiving plate is disposed just below the top edge cutting knife 43, bottom edge cutting knife 44 and the fore edge cutting knife 42 so that those knives functions as scissors.

The cutting station D further comprises a pressing plate 48 and a driving mechanism for moving up and down the pressing plate 48. The pressing plate 48 is disposed so as to moves up and down between a waiting position, which is positioned over the booklet bundle 32, and a working position where the pressing plate presses the booklet bundle 32 to the cutting table 23. The driving mechanism is comprised of a servomotor 49, which is fixed to a frame (not shown), a threaded shaft 47, which engages with a threaded hole disposed in a frame (not shown) and is supported so as to rotate around the axis thereof, one end of which is attached to the pressing plate 48, a nut 46 fixed to the threaded shaft 47, and a timing belt 45, which is tightly disposed around the rotation axis of the servomotor 49 and the nut 46. The servomotor 49 drives the threaded shaft 47 to rotate, then the pressing plate 48 moves up and down in the direction as shown by the arrow Qa. In this way, the booklet bundle 32 is pressed by the pressing plate 48 to the cutting table 23, then the booklet bundle is cut by the top edge cutting knife 43, bottom edge cutting knife 44 and fore edge cutting knife 42 in the cutting station.

The three-side trimmer 31 further comprises a control portion 24. The control portion 24 measures the height of the booklet bundle 32, on the basis of the sensing data of the sensors 54 disposed in the conveying apparatus. Then the control portion 24 controls the servomotor 59 in the chuck mechanism 40 so that that the height of the waiting position of the moving block 40*a* in the chuck mechanism 40 becomes to a height level corresponding to the height of the booklet bundle 32. And the control portion 24 controls the moving block 40*a* so that the moving block 40*a* move up and down between the adjusted waiting position and the working position. Simultaneously, the control portion 24 measures the height of the booklet bundle 32 from the data of the encoder 25 disposed in the chuck mechanism 40. The control portion 24 controls the servomotor 49, which drives the pressing plate 48, on the basis of the measured height of the booklet bundle. Therefore, the waiting position of the pressing plate 48 is adjusted to a height level corresponding to the height of the booklet bundle 32. The control portion 24 controls the pressing plate 48 so that the pressing plate 48 moves up and down between the adjusted waiting position and the working position.

Figure 7:
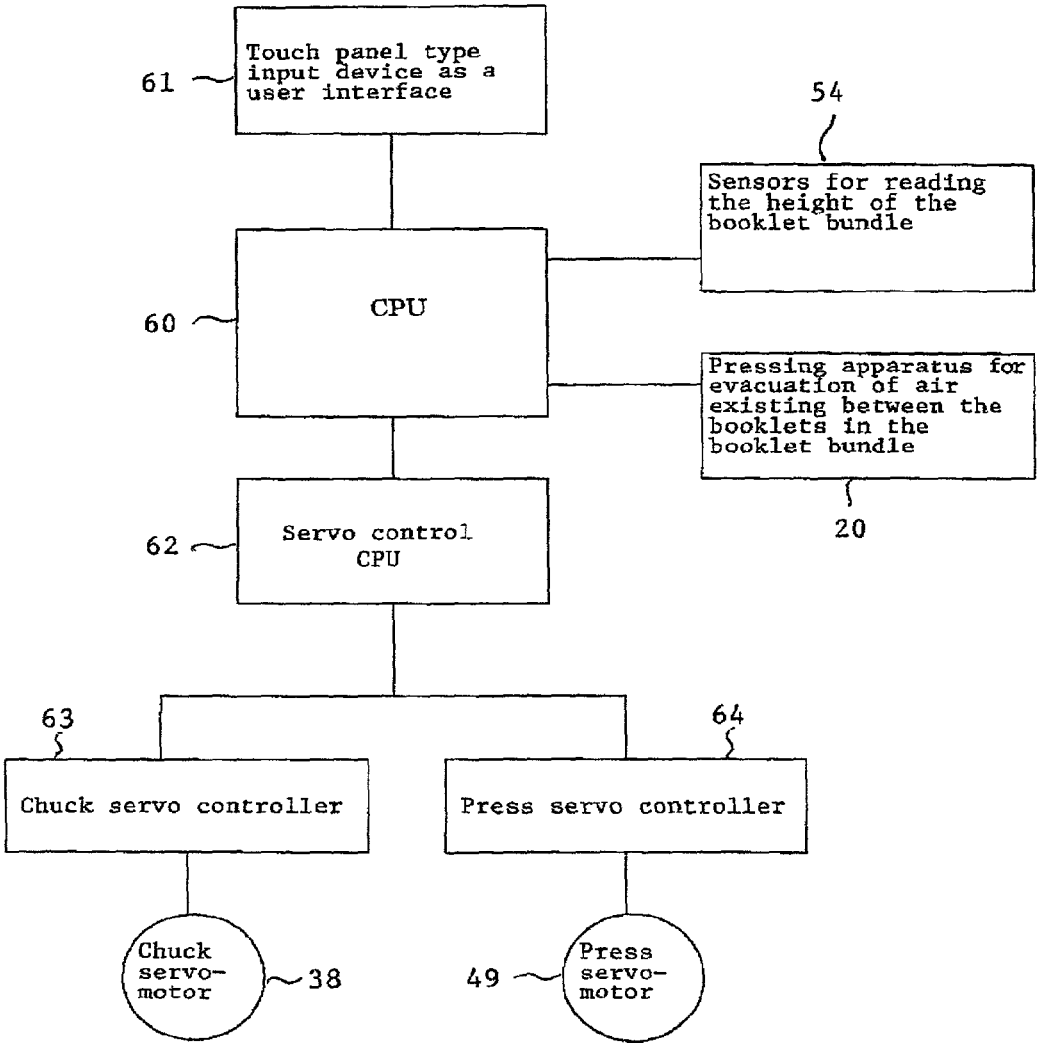
FIG. 7 is a block diagram of the control portion of the three-side trimmer shown in FIG. 1.

FIG. 7 is a block diagram showing the constitution of the control portion 24. The control portion 24 comprises, as shown in FIG. 7, a CPU (central processing unit) 60, and a touch panel type input device 61 for inputting data to the CPU 60 and outputting data from the CPU 60, which functions as a user interface. The control portion 24 further comprises a chuck servo controller 63 for controlling the servomotor 38 in the chuck mechanism 40 and a press servo controller 64 for controlling the servo motor 49, which drives the pressing plate 48. The control portion 24 further comprises a servo control CPU 62, which sends data to the CPU 60 and receives date from the CPU 60, and controls the chuck servo controller 63 and the press servo controller 64. The CPU 60 reads the sensing data of the sensors 54 in the conveying apparatus, and controls the air evacuating apparatus 20.

Figure 8:
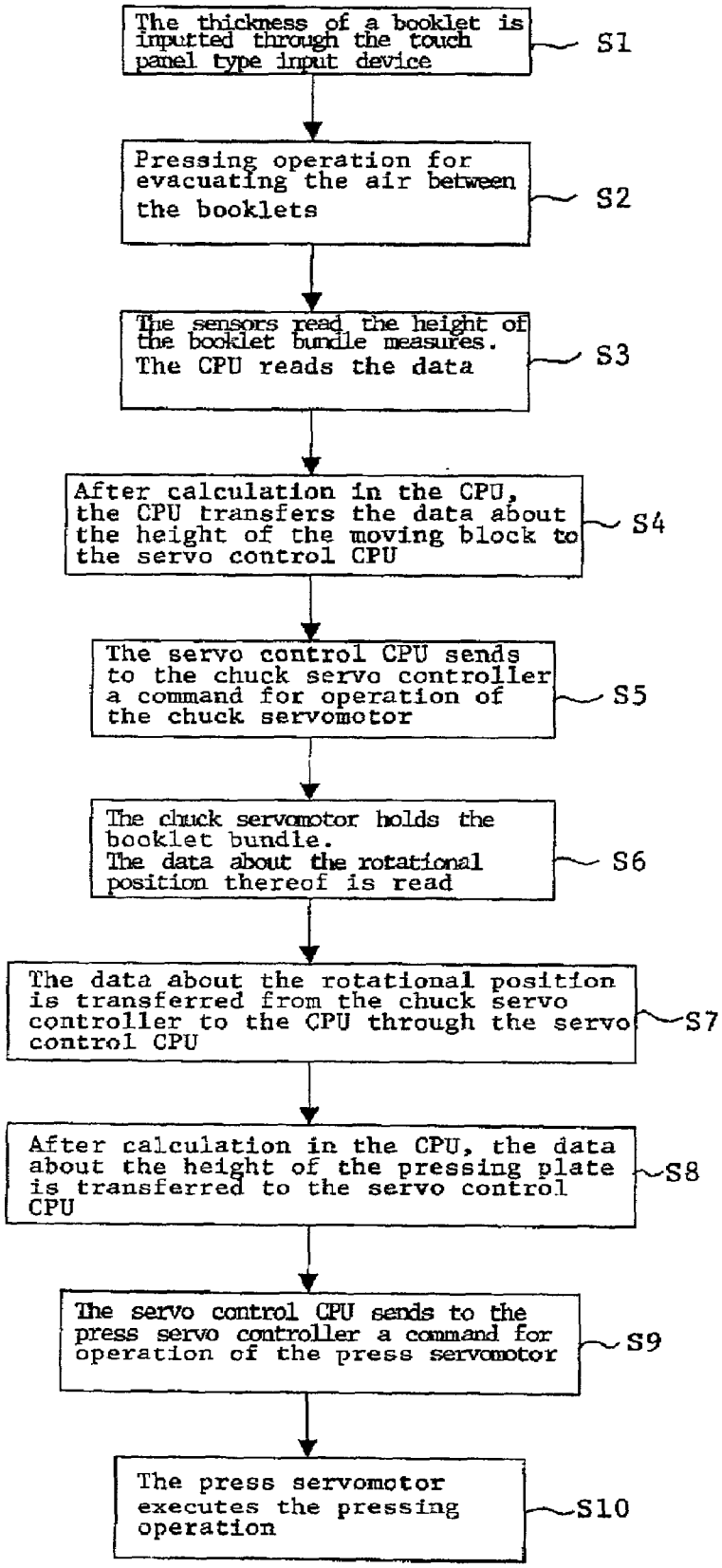
FIG. 8 is a flow chart explaining the function of the three-side trimmer shown in FIG. 1.
Figure 9:
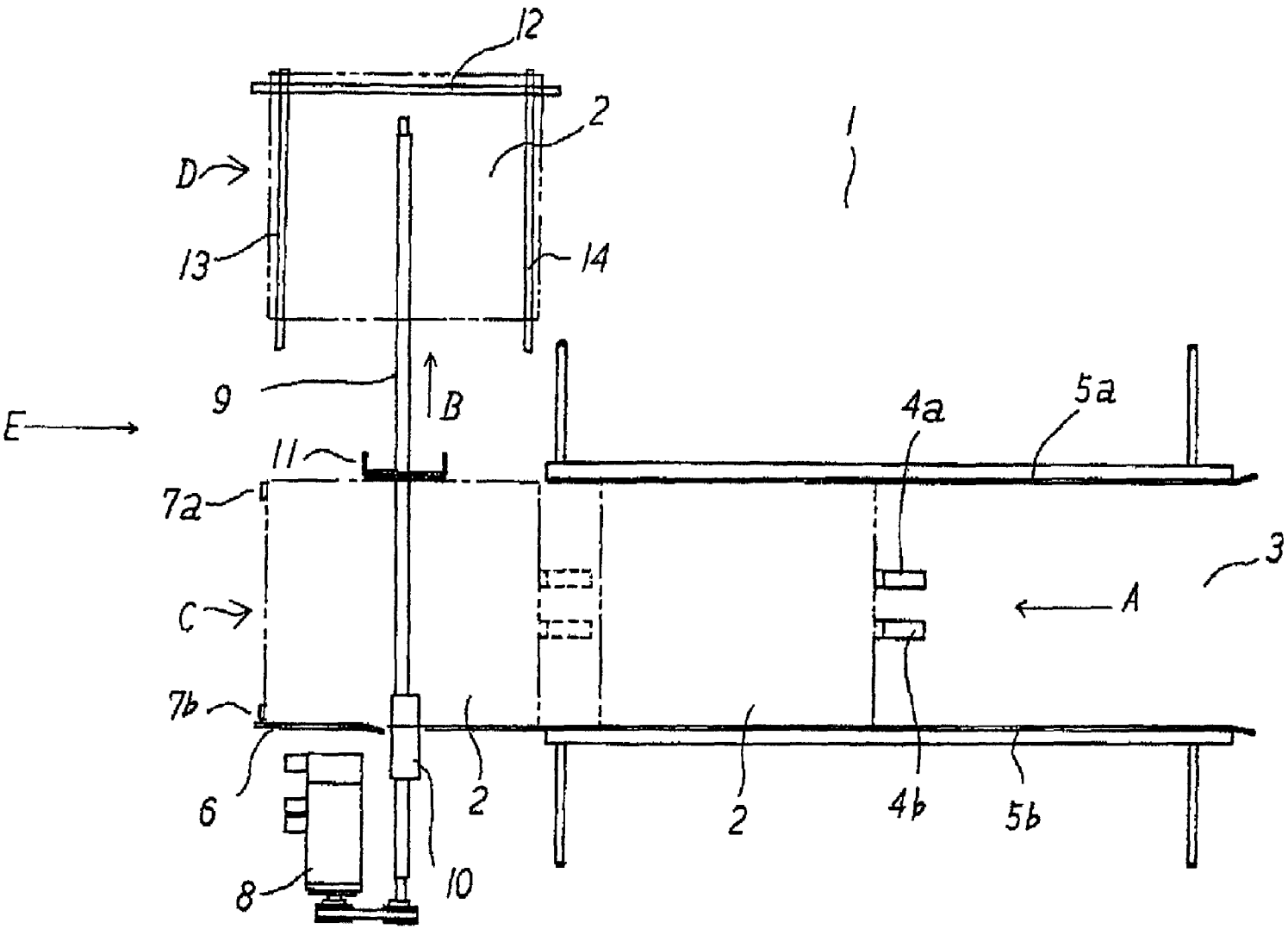
FIG. 9 (PRIOR ART)
FIG. 9 is a schematic plan view of the three-side trimmer in the prior art.
Figure 10:
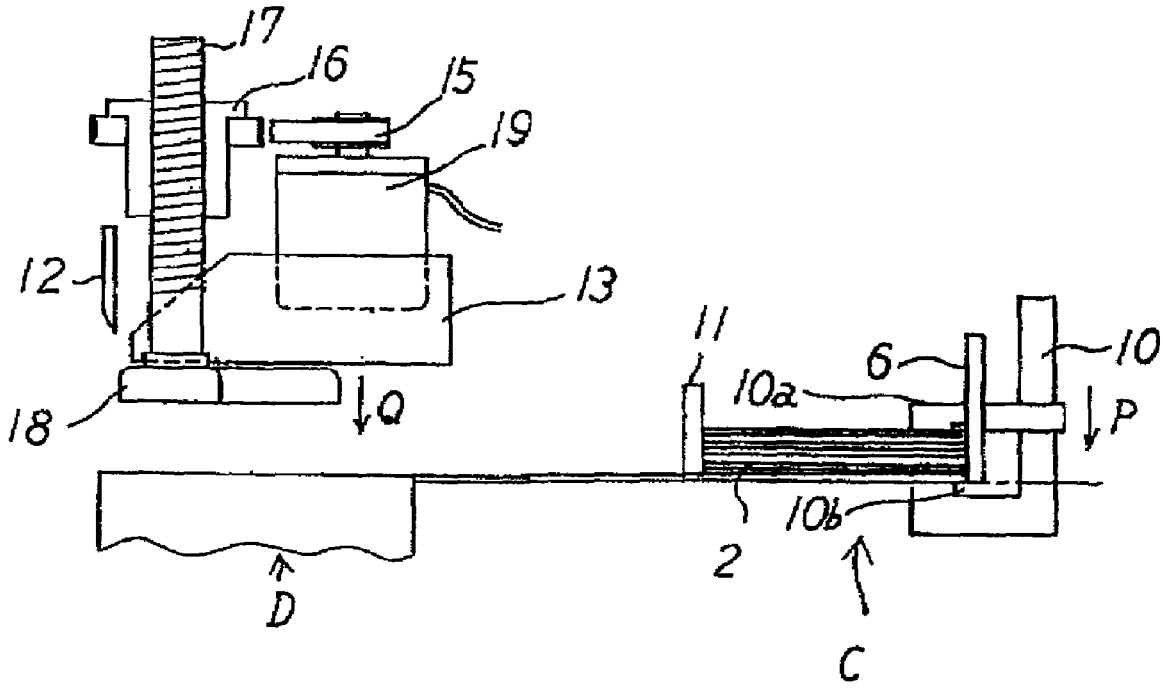
FIG. 10 (PRIOR ART)
FIG. 10 is a side view of the three-side trimmer seen from the direction shown by the arrow E in FIG. 9.

FIG. 8 is a flow diagram of the function of the three-side trimmer according to the present invention. Referring to FIG. 8, at first, the operator inputs the thickness of a booklet to the CPU 60 through the touch panel type input device 61 (Step S1 in FIG. 8). The booklet bundle 32 provided to the inlet of the receiving station F is conveyed onto the conveyer 33, and is pressed from the upper surface by the air evacuating apparatus 20 (Step S2 in FIG. 8). After the air evacuating procedure, the booklet bundle 32 reaches to the outlet of the receiving station F. Then the conveying apparatus holds the booklet bundle 32 in the vertical direction. In this moment, the CPU 60 reads the sensing data of the sensors 54 (Step S3 in FIG. 8).

CPU 60 obtains the height of booklet bundle 32 from the sensing data of the sensors 54. CPU 60 sends a height data of the waiting position of the moving block 40*a* in the chuck mechanism 40 to the servo control CPU 62 (Step S4 in FIG. 8). In the next stage, the servo control CPU 62 sends a command to the chuck servo controller 63 so as to work the chuck servomotor 38 (Step S5 in FIG. 8). According to this procedure, the waiting position of the moving block 40*a* in the chuck mechanism 40 is adjusted to a height level corresponding to the height of the booklet bundle 32. The moving block 40*a* moves down from this adjusted waiting position to the working position so as to hold the booklet bundle 32 in cooperation with the fixed block 40*c*. Simultaneously, data about the rotational position of the chuck servomotor 38 is read through the encoder 25 disposed in the chuck servomotor 38 (Step S6 in FIG. 8). The data about the rotational position is sent to the CPU 60 from the chuck serve controller 63 through the servo controller CPU 62 (Step S7 in FIG. 8). CPU 60 obtains the height of the booklet bundle 32 from the data about the rotational position, and the CPU 60 sends a data about the height of the waiting position of the pressing plate 48 to the servomotor control CPU 62 (Step S8 in FIG. 8). In this moment, the CPU 60 obtains the number of the booklets in the booklet bundle 32, on the basis of the height of the booklet bundle and the thickness of a booklet, which is inputted by the operator in Step S1. Then, servo control CPU 62 sends a command to the press servo controller 64 to execute the work (Step 89 in FIG. 8). According to this work command, the height of the waiting position of the pressing plate 48 is adjusted to a height level corresponding to the height of the booklet bundle 32. And the pressing plate 48 moves down from the adjusted waiting positions to the working position so as to press the booklet bundle 32.

Figure 4:
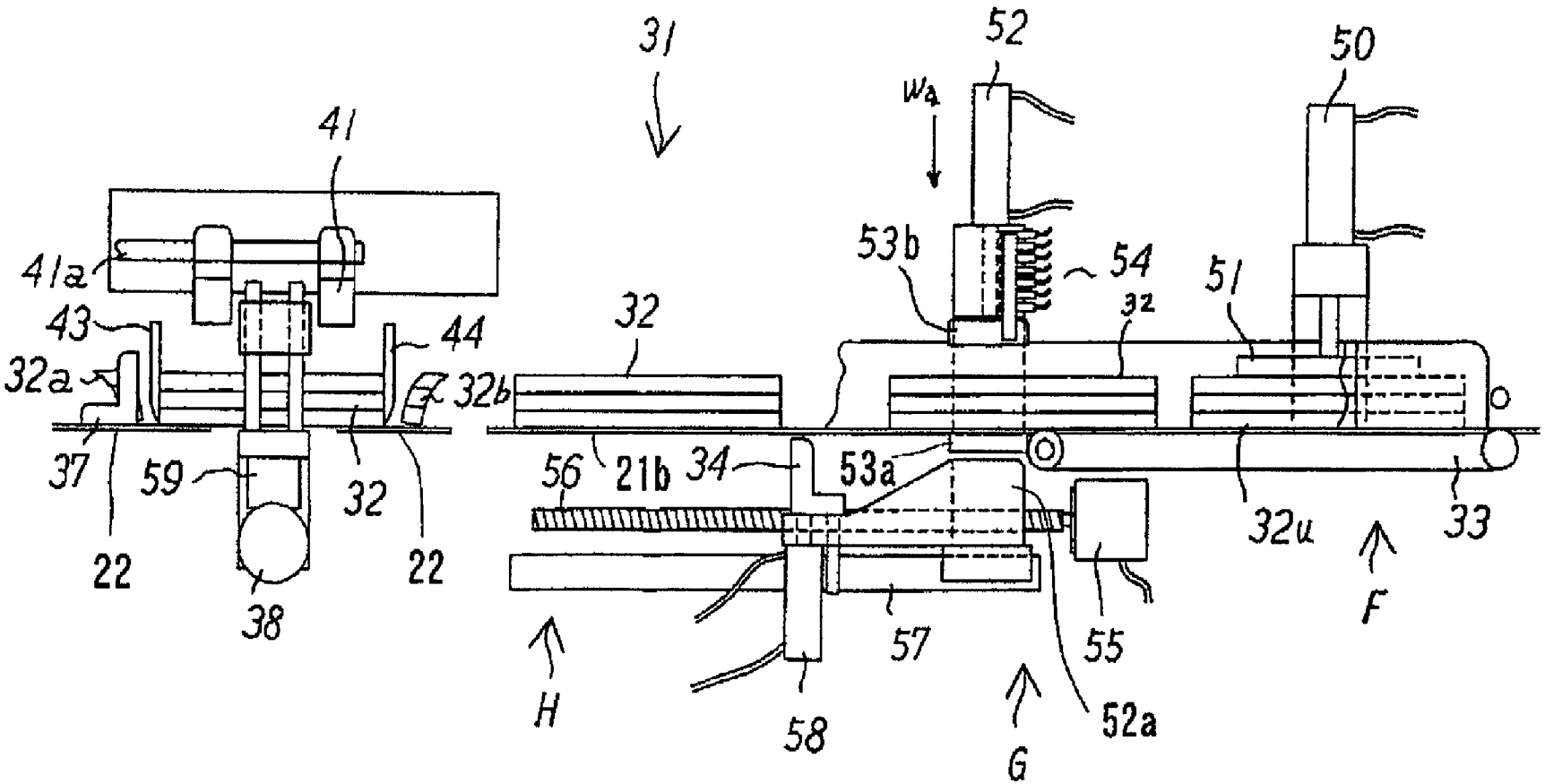
FIG. 4 is a front view of the three-side trimmer shown in FIG. 1, which shows the waiting state for conveying the next booklet bundle.
Figure 5:
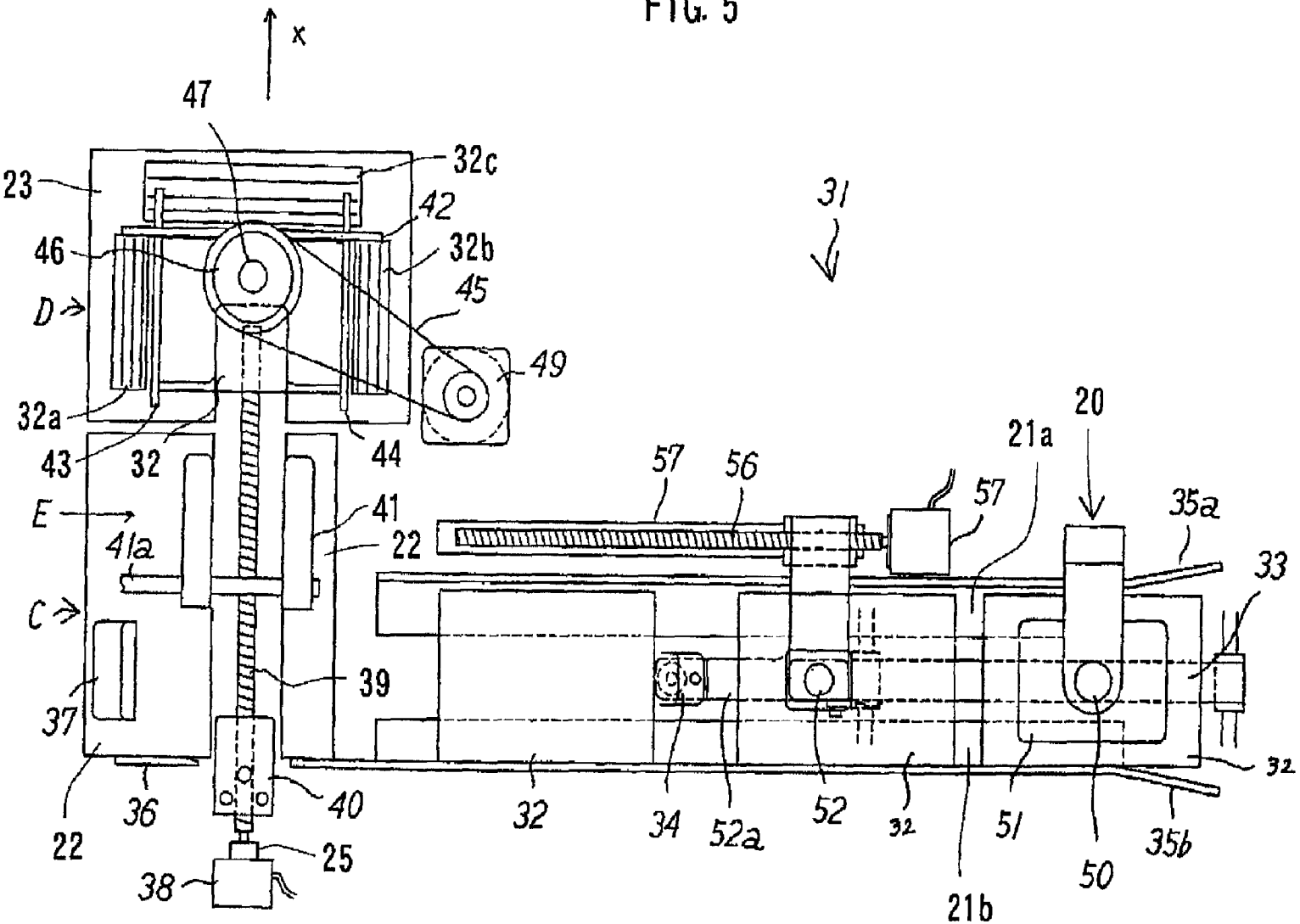
FIG. 5 is a plan view of the three-side trimmer shown in FIG. 4.
Figure 6:
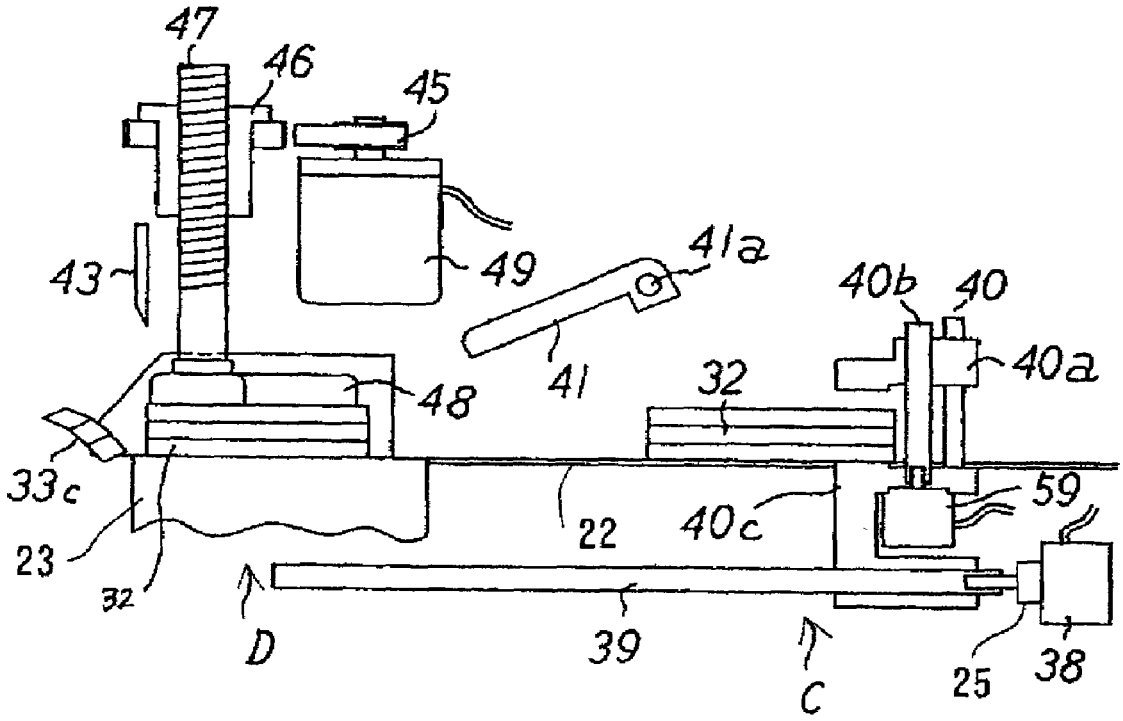
FIG. 6 is a side view of the three-side trimmer seen from the direction shown by the arrow E in FIG. 5.

FIGS. 4 to 6 show a three-side trimmer according to the present invention, the trimmer has finished the cutting procedure for the former booklet bundle, and is waiting the next booklet bundle. FIGS. 4, 5 and 6 are, respectively, a front view, plan view and a side view thereof. FIG. 6 is a side view seen from the direction shown by the arrow E in FIG. 5. When the first air cylinder in FIG. 4 is actuated, the booklet bundle 32 on the conveyer 33 is pressed by the pressing plate 51 so that the air resting between the booklets are evacuated. In this moment, the second air cylinder 52 has returned to the exit position G of the receiving station F. And the conveying claw 54 is retracted to the underside of the conveying path of the booklet bundle 32, namely, it has returned to the initial position thereof.

The chuck mechanism 40 in the alignment station C has returned to the initial position thereof, and the moving block 40*a* is in the waiting position thereof, namely it is ready to receive a booklet bundle. In the cutting station D, the top edge, bottom edge and fore edge of the booklet bundle 32 are cut by means of the top edge cutting knife 43, bottom edge cutting knife 44 and fore edge cutting knife 42. Reference numerals 32*a* to 32*c* in the drawings denote, respectively, chips separated from the booklet bundle 32. After the cutting procedure, the booklet bundle 32 is conveyed out to the direction shown by the arrow X.

As explained hereinbefore, in the three-side trimmer according to the present invention, the waiting position of the moving block 40*a* in the clamp mechanism 40, which conveys the booklet bundle 32 from the alignment station C to the cutting station D, can be adjusted to an appropriate height previously. The height can be adjusted before the execution of the conveying procedure by the clamp mechanism, on the basis of the height of the booklet bundle 32 which is measured while the booklet bundle is held by the conveyer, which conveys the booklet bundle from the receiving station F to the alignment station C. According to this feature of the invention, the time required for the holding of the booklet bundle 32 by means of the clamp mechanism 40, as well as the time required for the conveying of the booklet bundle 32 can be remarkably reduced. Further, the waiting position of the pressing plate 48 in the cutting station D can be adjusted to an appropriate height previously. The height can be adjusted before the execution of the pressing procedure by means of the pressing plate 48, on the basis of the height of the booklet bundle 32 which is measured while the booklet bundle is held by the clamp mechanism 40. According to this feature of the present invention, the time required for pressing procedure by means of the pressing plate 48 can be remarkably reduced. Consequently, a three-side trimmer, which can execute the trimming procedure more quickly compared to the prior art, can be provided according to the present invention.

The constitution of the present invention is not limited to the aforementioned embodiment. A various changes or amendments are possible within the scope of the invention defined in claims. For example, in this embodiment, the height of the booklet bundle is measured while the booklet bundle is held by the conveying apparatus in the vertical direction, which conveys the booklet bundle form the receiving station to the alignment station. Using this height of the booklet bundle, the height of the waiting position of the moving block in the chuck mechanism is adjusted. However, it is possible to measure the height of the pressing plate while the air evacuating apparatus instead of the conveying apparatus presses the booklet bundle. Then the height of the booklet bundle is obtained, and the height of the waiting position of the moving block in the chuck mechanism is adjusted, according to the obtained height of the booklet bundle. Further, in this embodiment, the height of the waiting position of the pressing plate in the cutting station is adjusted, according to the height of the booklet bundle which is measured while the chuck mechanism holds the booklet bundle in the vertical direction. However it is possible to adjust the height of the waiting position of the pressing plate, according to the height of the booklet bundle which is measured while the conveying apparatus in stead of the chuck mechanism holds the booklet bundle in the vertical direction, or which is obtained from the height of the pressing plate which is measured while the air evacuating apparatus presses the booklet bundle.

What is claimed is:

1. A three-side trimmer, comprising:

a receiving station for receiving booklets that are stacked into a bundle;

an alignment station for adjusting each booklet of the booklet bundle in a vertical direction;

an alignment means arranged in the alignment station for aligning at least one of a top edge and a bottom edge of the booklets along with a fore edge of the booklets;

a conveying means for holding the booklet bundle in the vertical direction and conveying the booklet bundle from the receiving station to the alignment station;

a cutting station for cutting the top edge, the bottom edge and the fore edge of the booklet bundle;

a cutting table arranged in the cutting station for supporting the booklet bundle thereon;

a top edge cutting knife arranged in the cutting station for upwardly and downwardly movement so as to cut the top edge of the booklet bundle;

a bottom edge cutting knife arranged in the cutting station parallel to the top edge cutting knife for upwardly and downwardly movement so as to cut the bottom edge of the booklet bundle;

a fore edge cutting knife arranged in the cutting station perpendicular to the top edge cutting knife and the bottom edge cutting knife for upwardly and downwardly movement so as to cut the fore edge of the booklet bundle;

a pressing plate arranged in the cutting station for upwardly and downwardly movement between a waiting position, which is positioned over the booklet bundle, and a working position where the pressing plate presses the booklet bundle to the cutting table;

a first drive mechanism for upwardly and downwardly moving the pressing plate;

a chuck mechanism for holding the booklet bundle in the vertical direction, and conveying the booklet bundle from the alignment station to the cutting station, the chuck mechanism comprising:

a fixed block for supporting a bottom surface of the booklet bundle;

a movable block upwardly and downwardly movable relative to the fixed block; and a second driving mechanism capable of driving the movable block between a waiting position, which is positioned over the booklet bundle, and a working position wherein the movable block pinches the booklet bundle in cooperation with the fixed block, characterized in that the three-side trimmer comprises a means for measuring a height of the booklet bundle when the booklet bundle is held by the conveying means; and a means for control in a controlling relationship with the first driving mechanism and the second driving mechanism the means for control capable of adjusting both the waiting position of the pressing plate and the waiting position of the movable block of the chuck mechanism correspondingly with the height of the booklet bundle according to a value measured by the means for measuring before the pressing plate and the movable block of the chuck mechanism initiate a next operation such that the booklet bundle can be trimmed faster.

2. The three-side trimmer of claim 1 wherein the number of the booklets to be cut is counted according to the value measured by the means for measuring along with a thickness of each booklet in the booklet bundle.

3. The three-side trimmer of claim 1 further comprising:

a receiving station for receiving the booklet bundle;

a conveying means for holding and conveying the booklet bundle from the receiving station to the alignment station; and a second measuring means for measuring a second height of the booklet bundle while the conveying means holds the booklet bundle.

4. The three-side trimmer of claim 3 wherein the chuck mechanism comprises:

a fixed block for supporting a bottom surface of the booklet bundle;

a moving block movable with respect to the fixed block; and a second driving means for moving the moving block between a second waiting position positioned over the booklet bundle and a second working position where the moving block pinches the booklet bundle in cooperation with the fixed block.

5. The three-side trimmer of claim 4 wherein the control means controls movement of the second driving means moving the moving block between the second waiting position and the second working position.

* * * * *